US008844409B2

(12) United States Patent
Lin

(10) Patent No.: US 8,844,409 B2
(45) Date of Patent: Sep. 30, 2014

(54) IMPACT DRIVER

(75) Inventor: Jack Lin, Taichung (TW)

(73) Assignee: Yih Cheng Factory Co., Ltd., Taichung (TW)

( * ) Notice: Subject to any disclaimer, the term of this patent is extended or adjusted under 35 U.S.C. 154(b) by 231 days.

(21) Appl. No.: 13/597,645

(22) Filed: Aug. 29, 2012

(65) Prior Publication Data

US 2014/0060269 A1 Mar. 6, 2014

(51) Int. Cl.

*B25B 19/00* (2006.01)
*B25B 21/02* (2006.01)
*B25B 23/00* (2006.01)

(52) U.S. Cl.

USPC ..... 81/463; 173/90

(58) Field of Classification Search

USPC ..... 81/463, 438; 173/90, 93.5, 93.6, 121
See application file for complete search history.

(56) References Cited

U.S. PATENT DOCUMENTS

| | | | | | |
|---|---|---|---|---|---|
| 5,321,999 | A * | 6/1994 | Lin | 81/463 |
| 5,827,290 | A * | 10/1998 | Bradley | 606/86 R |
| 5,908,076 | A * | 6/1999 | Marcengill et al. | 173/93 |
| 6,010,508 | A * | 1/2000 | Bradley | 606/86 R |
| 6,370,993 | B1 * | 4/2002 | Pitstick | 81/463 |
| 6,386,078 | B1 * | 5/2002 | Wu | 81/463 |
| 8,267,408 | B2 * | 9/2012 | Chen | 279/22 |
| 2003/0121681 | A1 * | 7/2003 | Ju | 173/93.5 |
| 2010/0044063 | A1 * | 2/2010 | Chen | 173/93.5 |
| 2012/0024117 | A1 * | 2/2012 | Kreutzer | 81/463 |
| 2012/0312131 | A1 * | 12/2012 | Necer | 81/463 |

* cited by examiner

*Primary Examiner* — David B Thomas

(57) ABSTRACT

An impact driver includes a sleeve, a striking unit and a chuck. The sleeve includes a bore with an open end and a polygonal section near the open end. The striking unit can strike a bit partially inserted in the sleeve through the open end. The chuck includes a ring, a tube, a spring and a ball. The tube includes a polygonal section movably inserted in the polygonal section of the bore of the sleeve, a circular section extended through the ring, an annular rib formed thereon, a polygonal bore for receiving the bit, and at least one aperture in communication with the polygonal bore. The spring is compressed between the annular rib and the sleeve. The ball includes a portion placed in the aperture and another portion movable into the polygonal bore.

10 Claims, 7 Drawing Sheets

IMPACT DRIVER

BACKGROUND OF INVENTION

1. Field of Invention

The present invention relates to a driver and, more particularly, to an impact driver.

2. Related Prior Art

An impact driver is a tool that delivers a strong, sudden rotational and downward force. In conjunction with a toughened screwdriver bit or a socket, an impact driver is often used to loosen a large threaded bolt or nut that is corrosively "frozen" or over-torqued. The direction can be reversed for situations where screws have to be tightened with torque greater than a screwdriver can reasonably provide.

A manual impact driver includes a sleeve provided around a core. The sleeve is much heavier than the core. The sleeve includes a spline formed on an internal face. The core includes a curved groove defined in the periphery. The spline is inserted in the curved groove. Thus, a user can hold the sleeve with one hand and use a hammer to strike the sleeve with the other hand to exert a turning force on the core and any bit attached to the core. The tool translates the movement of the sleeve to the rotation of the core to generate large values of torque. At the same time, the striking blow from the hammer forces the impact driver and the bit down into the screw.

Another type of impact driver uses a motor to automatically deliver rotational forces. These have the advantage of greatly increased speed. They are most often used in construction and manufacturing to replace screwdrivers where speed and operator fatigue are an issue. In some situations however, this type falls short since current designs cannot deliver the downward blow of a manual unit. This can be especially true on very stubborn fasteners. It is a common misconception that motorized impact drivers deliver a downward force when in fact they deliver no downward force at all.

The prior art is focused on provide adequate torque for driving a screw. There is however an important and unaddressed issue to drive a screw into a piece of material precisely in a desired position and direction.

The present invention is therefore intended to obviate or at least alleviate the problems encountered in prior art.

SUMMARY OF INVENTION

It is the primary objective of the present invention to provide an impact driver for driving a screw into a piece of material precisely in a desired position and direction.

To achieve the foregoing objectives, the impact driver includes a sleeve, a striking unit and a chuck. The sleeve includes a bore with an open end and a polygonal section near the open end. The striking unit can strike a bit partially inserted in the sleeve through the open end. The chuck includes a ring, a tube, a spring and a ball. The ring is connected to the sleeve. The tube includes a polygonal section movably inserted in the polygonal section of the bore of the sleeve, a circular section extended through the ring, an annular rib formed thereon, a polygonal bore for receiving the bit, and at least one aperture in communication with the polygonal bore. The spring is compressed between the annular rib and the sleeve. The ball includes a portion placed in the aperture and another portion movable into the polygonal bore.

Other objectives, advantages and features of the present invention will be apparent from the following description referring to the attached drawings.

BRIEF DESCRIPTION OF DRAWINGS

The present invention will be described via detailed illustration of two embodiments referring to the drawings wherein.

DETAILED DESCRIPTION OF EMBODIMENTS

Figure 1:
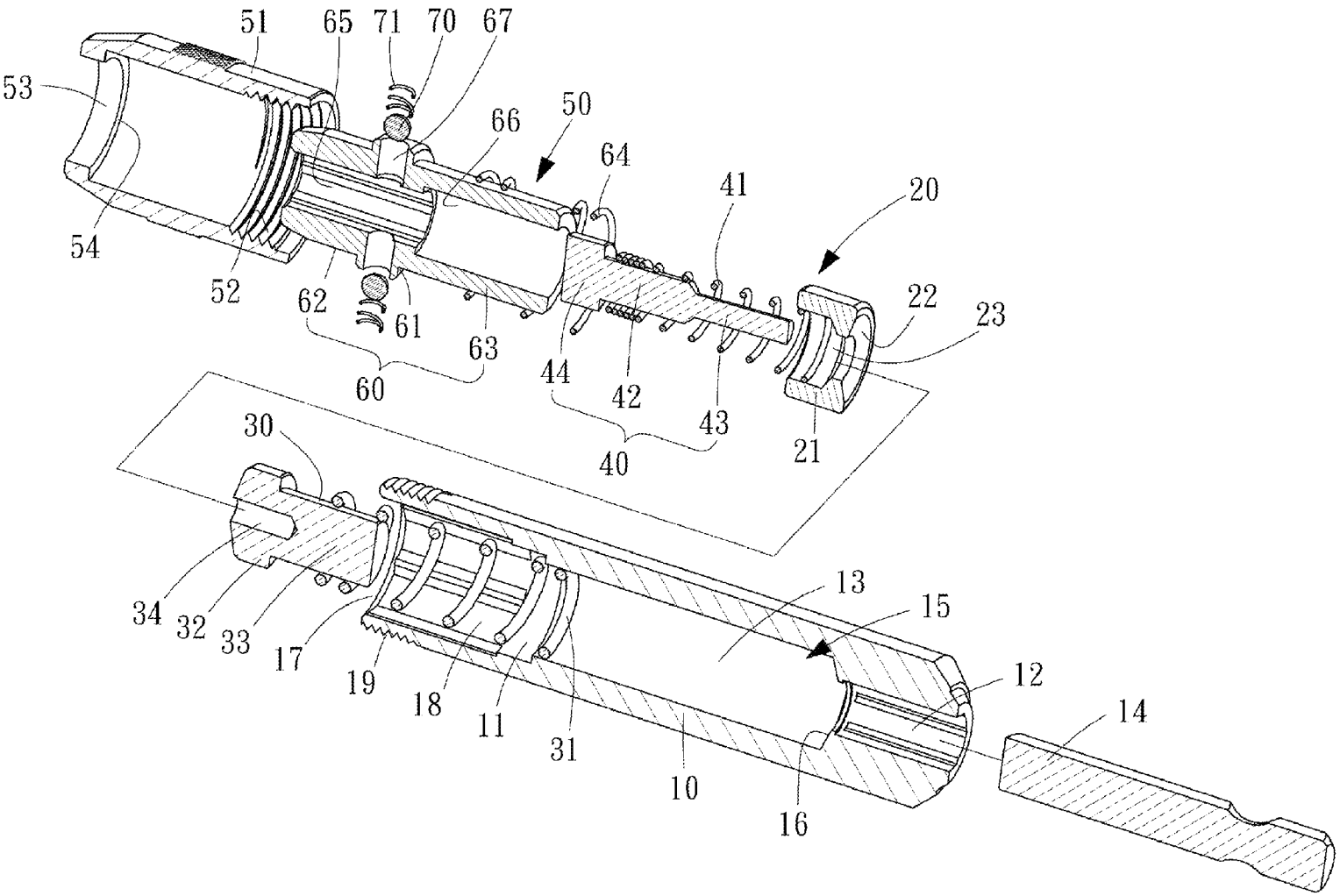
FIG. 1 is an exploded view of an impact driver according to the first embodiment of the present invention.

Referring to FIGS. 1 through 5, there is shown an impact driver according to a first embodiment of the present invention. The impact driver includes a sleeve 10, a striking unit 20 and a chuck 50. The striking unit 20 includes a guiding element 21, a hammer 30 and a pusher 40. The chuck 50 includes a ring 51, a tube 60 and two balls 70.

The sleeve 10 includes a bore 15 axially defined therein. The bore 15 includes a first polygonal section 12, a first circular section 13, a second circular section 11 and a second polygonal section 18. The first polygonal section 12 is preferably a hexagonal section. The diagonal line of the first polygonal section 12 is shorter than the diameter of the first circular section 13 that is longer than the diameter of the second circular section 11. The second polygonal section 18 is preferably a hexagonal section. The distance between any two opposite facets of the second polygonal section 18 is longer than the diameter of the second circular section 11. There is a thread 19 extending on the periphery of the sleeve 10 near the open end 17.

A polygonal rod 14 is fit in the first polygonal section 12 so that the bore 15 includes a closed end 16 near the first polygonal section 12 blocked by the polygonal rod 14. The bore 15 further includes an open end 17 near the second polygonal section 18.

The guiding element 21 is an annular element with two a bore 23 axially defined therein. The bore 23 includes two sections. The diameter of the first section of the bore 23 is shorter than that of the second section of the bore 23. The guiding element 21 further includes a first conical concave face 22 at an end near the first section of the bore 23 and a second conical concave face 22 between the first and second sections of the bore 23.

The hammer 30 includes a first section 33 and a second section 32. The diameter of the first section 33 is longer than that of the second section 32. The length of the first section 33 is shorter than that of the second section 32. A bore 34 is defined in the hammer 30 axially. The bore 34 includes an open end in the first section 33 and a closed end in the second section 32.

The pusher 40 includes a first section 43, a second section 42 and a third section 44. The diameter of the first section 43 is shorter than that of the second section 42. The diameter of the second section 42 is shorter than that of the third section 44. The length of the first section 43 of the pusher 40 is longer than the depth of the bore 34 of the hammer 30 for reasons to be given.

The ring 51 includes a bore 53 axially defined therein. The bore 53 includes two sections. The diameter of the first section of the bore 53 is longer than that of the second section of the bore 53. A shoulder 54 is formed between the first and second sections of the bore 53. The ring 51 further includes a thread 52 extending on a portion of the wall of the first section of the bore 53.

The tube 60 is a tubular element. On the outside, the tube 60 includes an annular rib 61 formed between a circular section 62 and a polygonal section 63. On the inside, the tube 60 includes a polygonal bore 65 axially defined therein, a circular bore 66 axially defined therein, and two apertures 67 defined therein in a radial manner. The polygonal bore 65 extends throughout the circular section 62 of the tube 60 and extends in a portion of the polygonal section 63 of the tube 60. The circular bore 66 is axially defined in the other portion of the polygonal section 63 of the tube 60.

Figure 2:
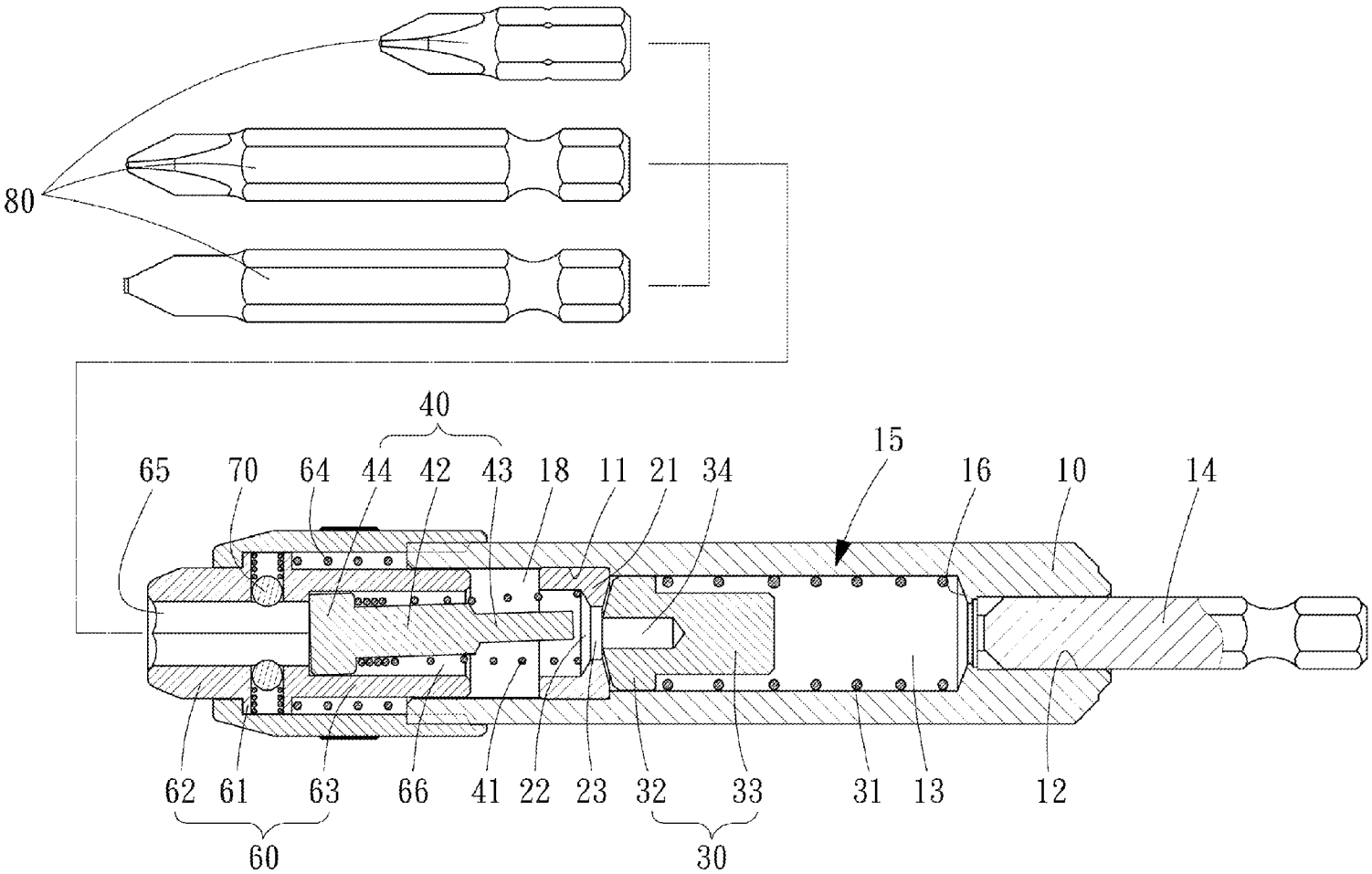
FIG. 2 is a cross-sectional view of the impact driver shown in FIG. 1.

Referring to FIG. 2, a spring 31 and the hammer 30 are placed in the first circular section 13 of the sleeve 10. The spring 31 is compressed between the closed end 16 of the chamber of the sleeve 10 and the second section 32 of the hammer 30. The guiding element 21 is fit in second circular section 11, near the first circular section 13. Thus, the spring 31 and the hammer 30 are kept in the first circular section 13 of the sleeve 10.

The sections 43 and 42 of the pusher 40 are inserted in a spring 41. An end of the spring 41 and the first section 43 of the pusher 40 are sequentially placed in the second section of the bore 23 of the guiding element 21. The spring 41 is compressed between the second conical face 22 and the third section 44 of the pusher 40. It should be noted that the pusher 40 is not coaxial with the guiding element 21 and the hammer 30.

The polygonal section 63 of the tube 60 is inserted in the second polygonal section 18 of the sleeve 10 through a spring 64. The spring 64 is compressed between the open end 17 of the sleeve 10 and the annular rib 61 of the tube 60. The sections 42 and 44 of the pusher 44 are placed in the circular bore 66 of the tube 60. Each of the balls 70 and a spring 71 are sequentially placed in a respective one of the apertures 67.

The ring 51 is placed around the tube 60 and the sleeve 10. The thread 52 of the ring 51 is engaged with the thread 19 of the sleeve 10. Thus, the pusher 40, the holder 60, the balls 70 and the springs 41, 64 and 71 are kept in position.

Figure 3:
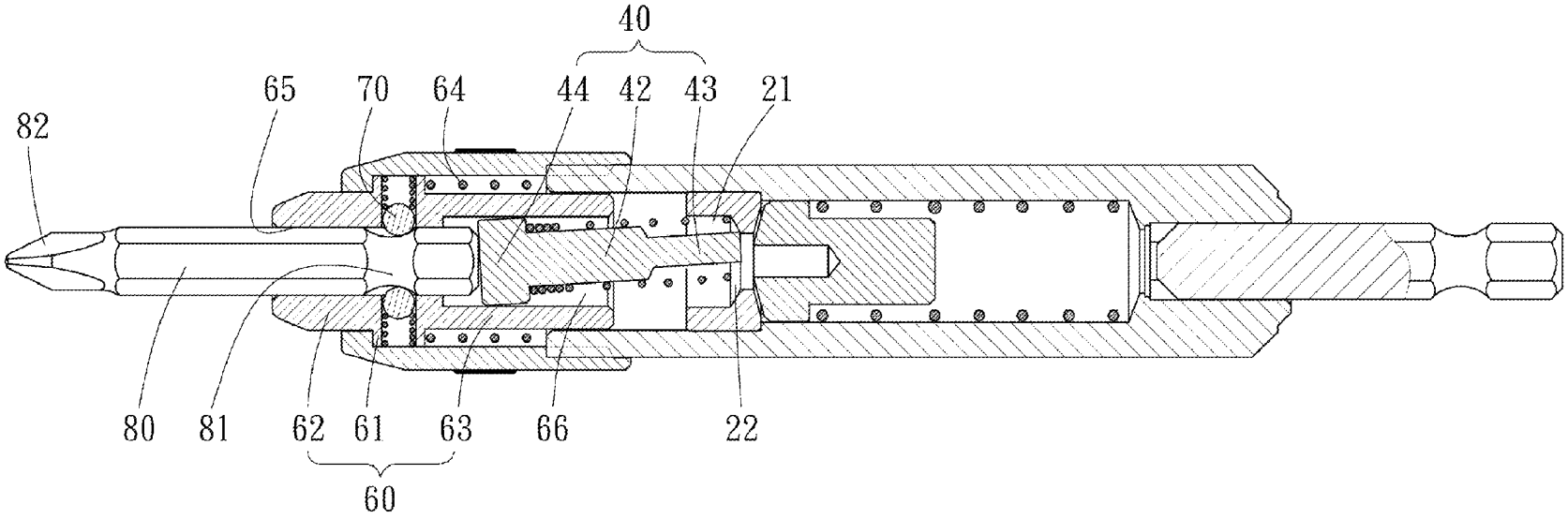
FIG. 3 is a side view of a bit attached to the impact driver shown in FIG. 2.

Referring to FIG. 3, a root of a bit 80 is inserted in the polygonal bore 65 of the tube 60 while a tip 82 of the bit 80 is placed outside the tube 60. The root of the bit 80 is biased against the third section 44 of the pusher 40. A reduced portion 81 of the bit 80 is pinched by the balls 70 biased by the springs 71. Although not shown, the tip 82 of the bit 80 is placed against a head of a screw while a tip of the screw is placed against a piece of wood or metal such as aluminum. Although not shown, the polygonal rod 14 is connected to an automatic tool such as a pneumatic or electric tool.

Figure 4:
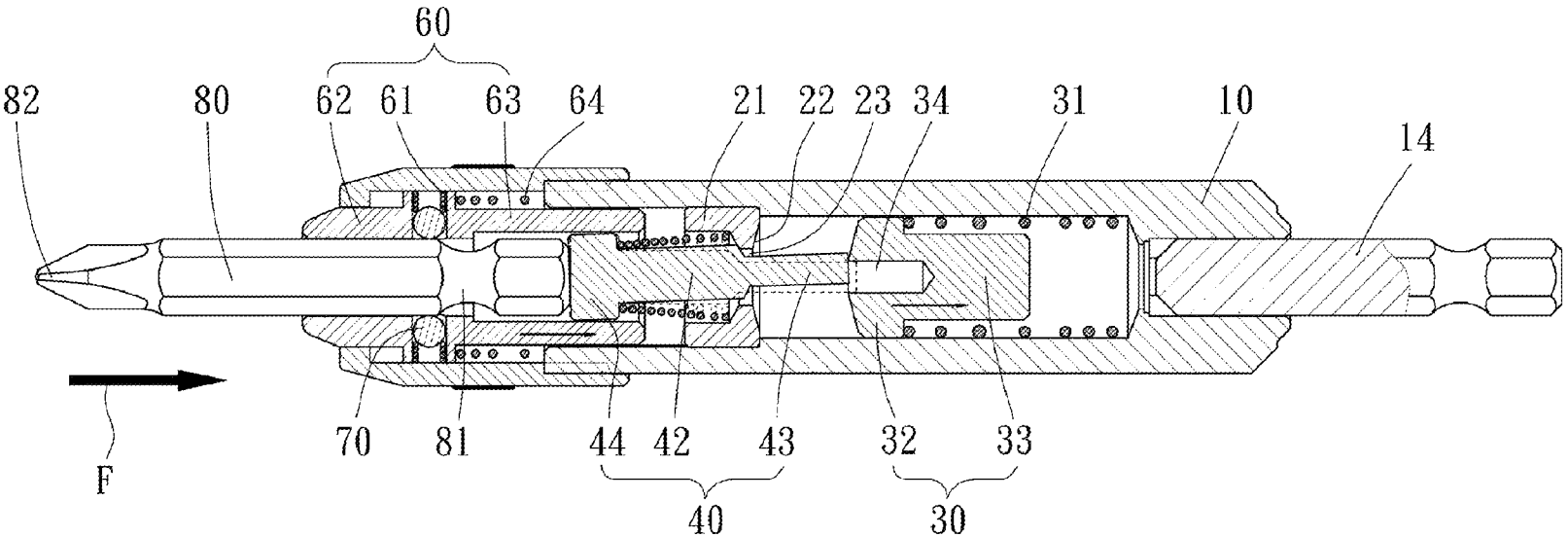
FIG. 4 is a cross-sectional view of the impact driver in another position than shown in FIG. 3.

In operation, the automatic tool is pushed toward the piece of wood or metal. The screw is abutted against the piece of wood or metal by the bit 80. The bit 80 is kept in position by the screw. The tube 60 is moved further into the sleeve 10 by the bit 80 because the tube 60 sticks to the balls 70 that are trapped by the reduced portion 81 of the bit 80. Thus, the spring 64 is further loaded. Eventually, the spring 64 is adequately loaded to overcome the springs 71 to push the balls 70 out of the reduced portion 81 of the bit 80 and move the tube 60 away from the sleeve 10 as shown in FIG. 4. Again, the bit 80 is held firmly in position by the tube 60.

The pusher 40 is moved by the bit 80. The spring 41 is further loaded by the pusher 40. The hammer 30 is moved by the pusher 40 since they are not coaxial with each other. The spring 31 is further loaded by the hammer 30.

Figure 5:
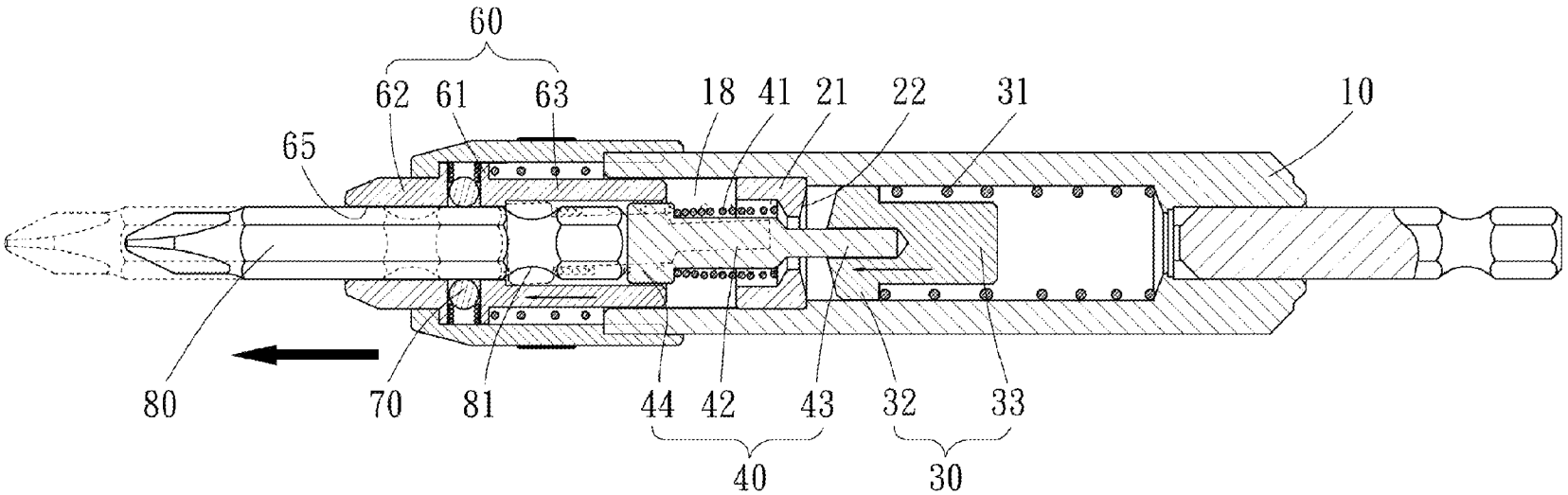
FIG. 5 is a cross-sectional view of the impact driver in another position than shown in FIG. 4.

Referring to FIG. 5, the second conical face 22 of the guiding element 21 guides the second section 42 of the pusher 40 so that the pusher 40 is coaxial with the hammer 30 to allow insertion of the first section 43 of the pusher 40 into the bore 34 of the hammer 30, i.e., to allow the spring 31 to move the hammer 30 toward the pusher 40 fast. Eventually, the hammer 30 strikes the pusher 40. The pusher 40 strikes the bit 80. The bit 80 strikes the screw. The screw makes a dent in the piece of wood or metal precisely in a desired position. The automatic tool is actuated to drive the screw into the piece of wood or metal via the impact driver.

With the previous production of the dent, the screw is driven in the piece of wood or metal precisely in the desired position. Moreover, with the previous with the previous production of the dent, the screw is driven in the piece of wood or metal precisely in the desired direction, i.e., the axis of the screw is perpendicular to the surface of the piece of wood or metal.

Figure 6:
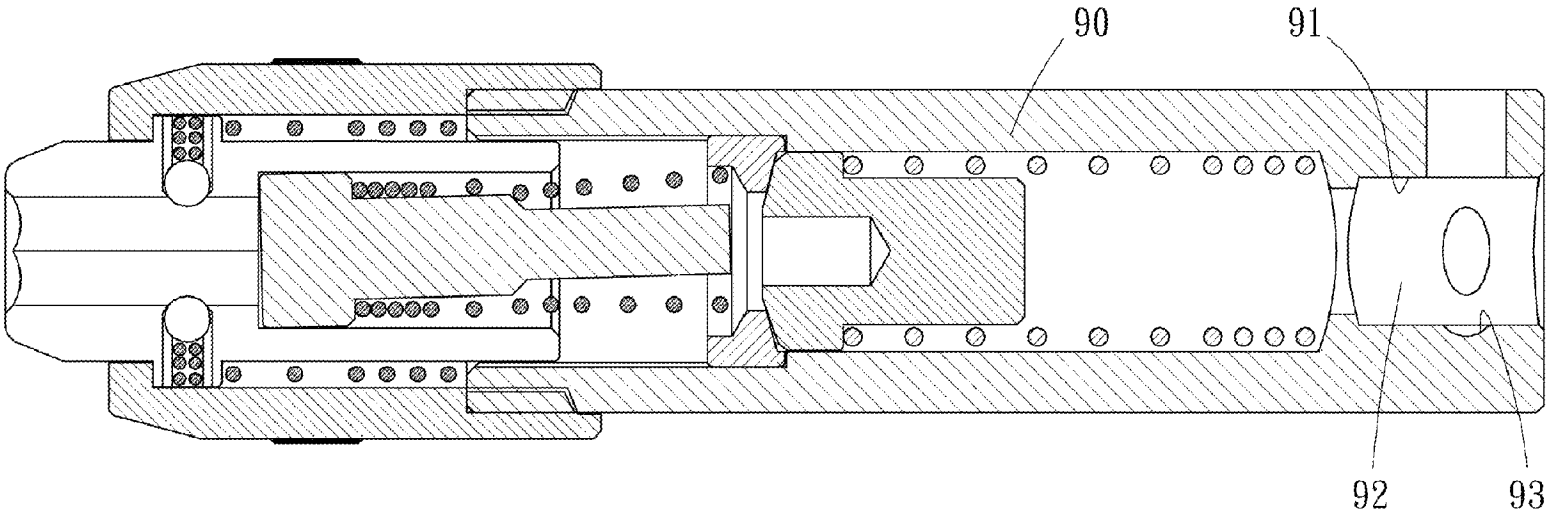
FIG. 6 is a cross-sectional view of an impact driver according to the second embodiment of the present invention.

Referring to FIG. 6, there is shown an impact driver according to a second embodiment of the present invention. The second embodiment is like the first embodiment except including a sleeve 90 instead of the sleeve 10. The sleeve 90 is like the sleeve 10 except that the bore 15 includes a polygonal section 91 instead of the polygonal section 12. The polygonal section 91 is a square bore. There is a recess 93 defined in one of four facets 92 of the polygonal section 91.

Figure 7:
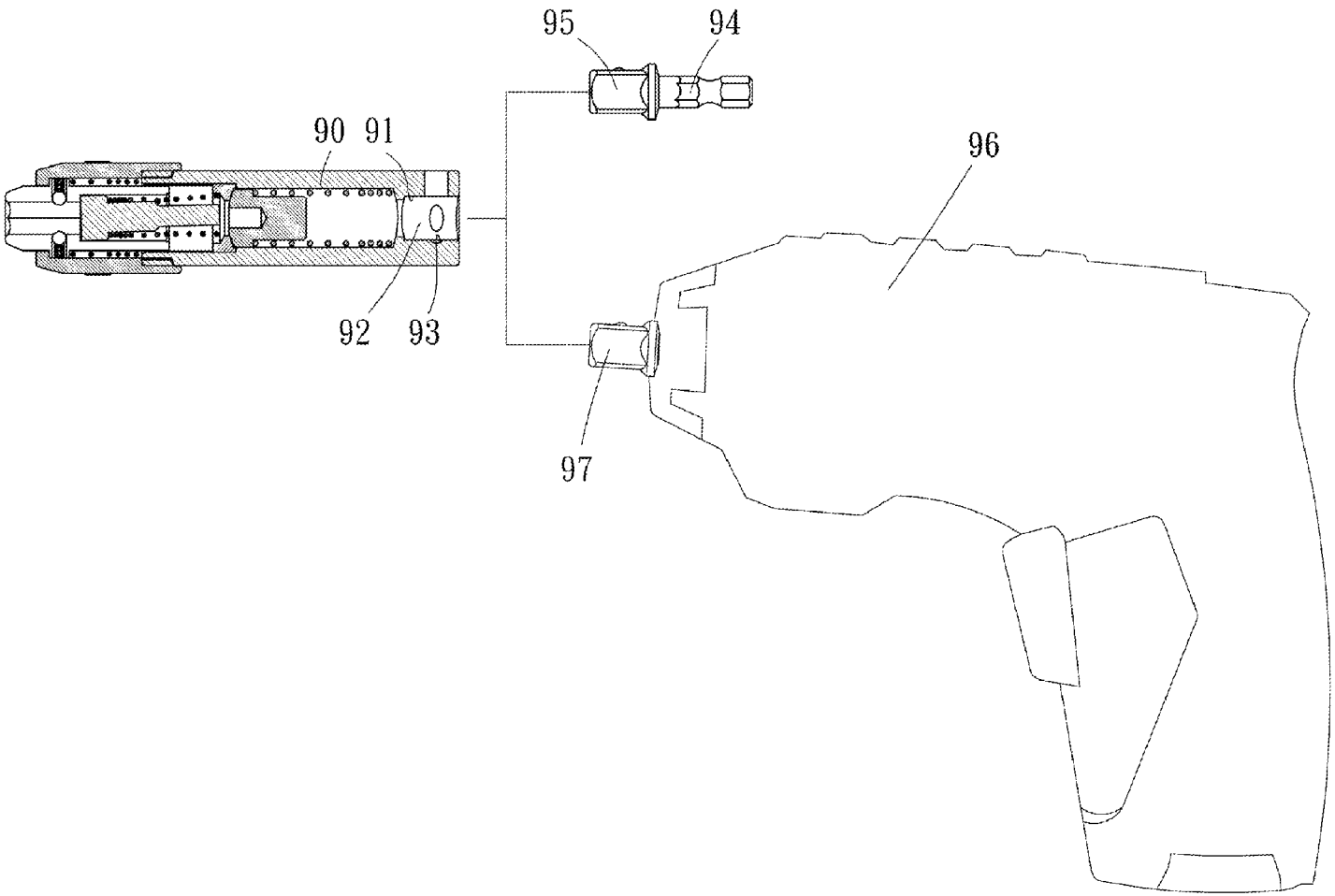
FIG. 7 is a side view of an automatic tool for actuating the impact driver shown in FIG. 6.

Referring to FIG. 7, there is shown an extensive element formed with a hexagonal section 94, a square section 95 and a spring-biased ball attached to the square section 95. The square section 94 of the extensive element can be inserted in the square section 91 while the spring-biased ball can be placed in the recess 93.

There is shown an automatic tool 96 that includes a square axle 97 and a spring-biased ball attached to the square axle 97. Alternatively, the square axle 97 can be inserted in the square section 91 while the spring-biased ball can be placed in the recess 93.

The present invention has been described via the detailed illustration of the embodiments. Those skilled in the art can derive variations from the embodiments without departing from the scope of the present invention. Therefore, the embodiments shall not limit the scope of the present invention defined in the claims.

The invention claimed is:

1. An impact driver including:

a sleeve including a bore with an open end and a polygonal section near the open end;

a striking unit for striking a bit partially inserted in the sleeve through the open end; and a chuck including:

a ring connected to the sleeve;

a tube including a polygonal section movably inserted in the polygonal section of the bore of the sleeve, a circular section extended through the ring, an annular rib formed thereon, a polygonal bore for receiving the bit, and at least one aperture in communication with the polygonal bore;

a spring compressed between the annular rib and the sleeve; and at least one ball including a portion placed in the aperture and another portion movable into the polygonal bore.

2. The impact driver according to claim 1, wherein the chuck includes another spring compressed between the ball and the ring.

3. The impact driver according to claim 1, wherein the ring includes an annular shoulder for abutting the annular rib.

4. The impact driver according to claim 1, wherein the striking unit includes:

a hammer movably placed in the sleeve and formed with a bore;

a spring compressed between the hammer and the sleeve;

a guiding element fit in the sleeve and formed with a conical concave face and a bore in communication with the bore of the hammer;

a pusher including a thick section abutted against the tube and a thin section for insertion into the bore of the hammer as the pusher is guided by the conical concave face of the guiding element; and another spring compressed between the guiding element and the thick section of the pusher so that the pusher is normally not coaxial with the hammer.

5. The impact driver according to claim 4, wherein the tube includes a circular bore for containing the thick section of the pusher.

6. The impact driver according to claim 5, wherein the circular bore is made with a diameter longer than that of the polygonal bore.

7. The impact driver according to claim 6, wherein the thick section of the pusher is abutted against an annular shoulder formed between the polygonal and circular bores.

8. An impact driver including:

a sleeve including a bore with an open end and a polygonal section near the open end;

a striking unit for striking a bit partially inserted in the sleeve through the open end, wherein the striking unit includes:

a hammer movably placed in the sleeve and formed with a bore;

a spring compressed between the hammer and the sleeve;

a guiding element fit in the sleeve and formed with a conical concave face and a bore in communication with the bore of the hammer;

a pusher including a thick section abutted against the tube and a thin section for insertion into the bore of the hammer as the pusher is guided by the conical concave face of the guiding element; and another spring compressed between the guiding element and the thick section of the pusher so that the pusher is normally not coaxial with the hammer; and a chuck including:

a ring connected to the sleeve and formed with an annular shoulder for abutting the annular rib;

a tube including a polygonal section movably inserted in the polygonal section of the bore of the sleeve, a circular section extended through the ring, an annular rib formed thereon, a polygonal bore for receiving the bit, a circular bore for containing the thick section of the pusher, and at least one aperture in communication with the polygonal bore;

a spring compressed between the annular rib and the sleeve;

at least one ball including a portion placed in the aperture and another portion movable into the polygonal bore; and another spring compressed between the ball and the ring.

9. The impact driver according to claim 8, wherein the circular bore is made with a diameter longer than that of the polygonal bore.

10. The impact driver according to claim 9, wherein the thick section of the pusher is abutted against an annular shoulder formed between the polygonal and circular bores.

* * * * *